United States Patent [19]

Tapia

[11] 4,037,435

[45] July 26, 1977

[54] AUXILIARY FEED ATTACHMENT FOR A CIRCULAR KNITTING MACHINE

[75] Inventor: Everardo Tapia, Mexico City, Mexico

[73] Assignee: Speizman Industries, Inc., Charlotte, N.C.

[21] Appl. No.: 721,988

[22] Filed: Apr. 17, 1968

[51] Int. Cl.[2] ..... D04B 15/54; D04B 23/22; D04B 27/02

[52] U.S. Cl. ..... 66/142; 66/141; 66/187

[58] Field of Search ..... 66/134, 146, 9, 80, 66/125, 133, 147, 169, 41, 170, 1, 171, 19, 172, 21, 22, 26, 174, 95, 173, 148, 149, 201, 150, 153, 184, 185, 186, 187; 128/155, 156, 290, 296; 2/239, 21

[56] References Cited

U.S. PATENT DOCUMENTS

| | | | |
|---|---|---|---|
| 456,710 | 7/1891 | Thurstensen | 66/149 |
| 966,746 | 8/1910 | Hoefer et al. | 66/1 |
| 1,443,999 | 2/1923 | Merli et al. | 66/146 X |
| 1,520,162 | 12/1924 | Vittori et al. | 66/9 |
| 1,662,678 | 3/1928 | Judson | 66/149 |
| 2,013,563 | 9/1935 | Lawson et al. | 66/149 X |
| 2,016,055 | 10/1935 | Shelmire | 66/134 |
| 2,053,192 | 9/1936 | Grothey | 66/134 X |
| 2,168,224 | 8/1939 | Lawson et al. | 66/134 |
| 2,292,231 | 8/1942 | Lesavoy | 66/9 X |
| 2,694,304 | 11/1954 | Butler | 66/150 |
| 2,729,082 | 1/1956 | Tew | 66/149 |
| 3,236,070 | 2/1966 | Clayton, Jr. | 66/187 UX |
| 3,340,706 | 9/1967 | Currier | 66/1 X |
| 3,345,699 | 10/1967 | Burger | 66/9 X |
| Re. 19,995 | 6/1936 | Page | 66/134 |

*Primary Examiner*—Ronald Feldbaum

[57] ABSTRACT

A tubular knit fabric article having a two ply end portion that is confined to a reduced tubular size at the outer end thereof by an auxiliary yarn disposed between the plies in an unknit constricting loop and with the ends of the auxiliary yarn knit in the fabric of the plies. The constricting loop is formed by feeding the auxiliary yarn to the needle circle of a circular knitting machine during the knitting of a welt-like portion using an auxiliary yarn feeding attachment that first feeds the auxiliary yarn for knitting the leading end in the tubular fabric, then feeds the auxiliary yarn under tension in a non-knitting position at which the yarn is drawn by the previously knit leading end around the tubular fabric in a constricting loop or loops, and then cuts the trailing end of the auxiliary yarn, which is disposed in the needle circle for knitting in the tubular fabric.

3 Claims, 19 Drawing Figures

Fig. 1
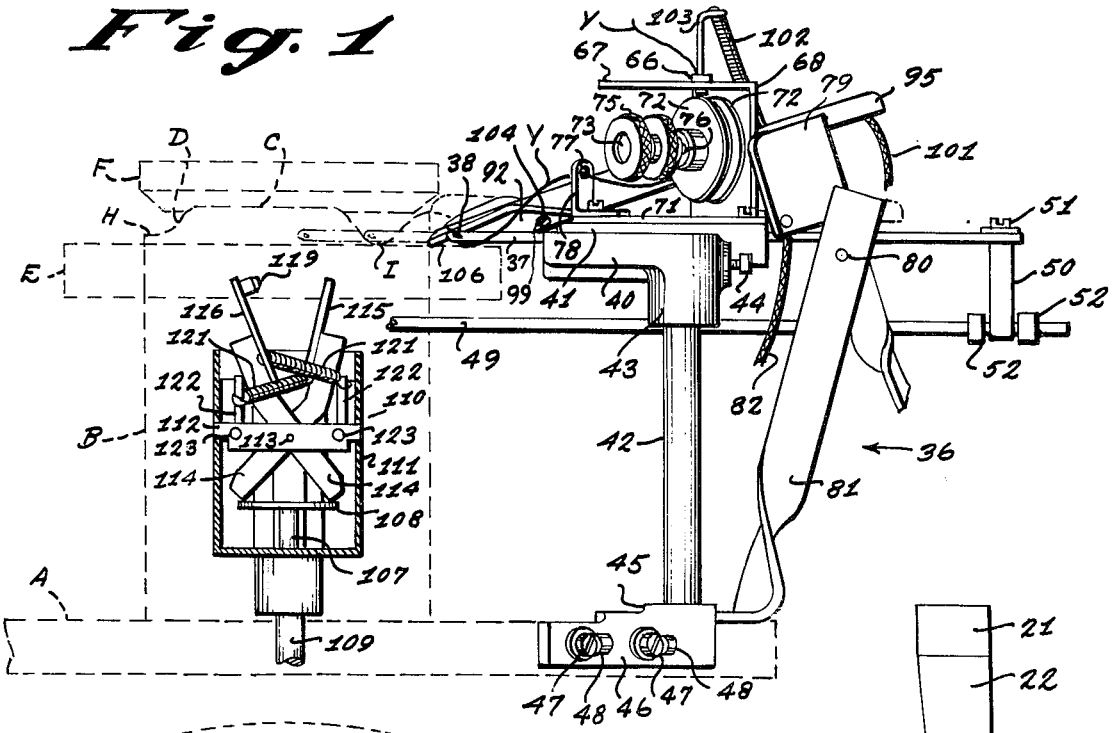
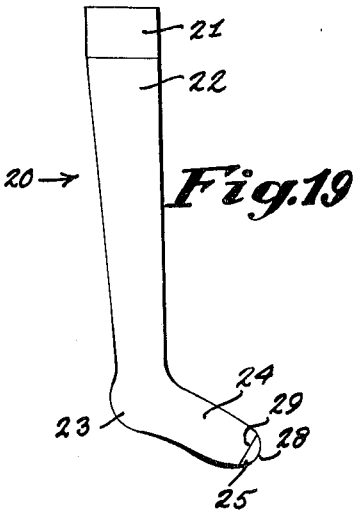
Fig. 19
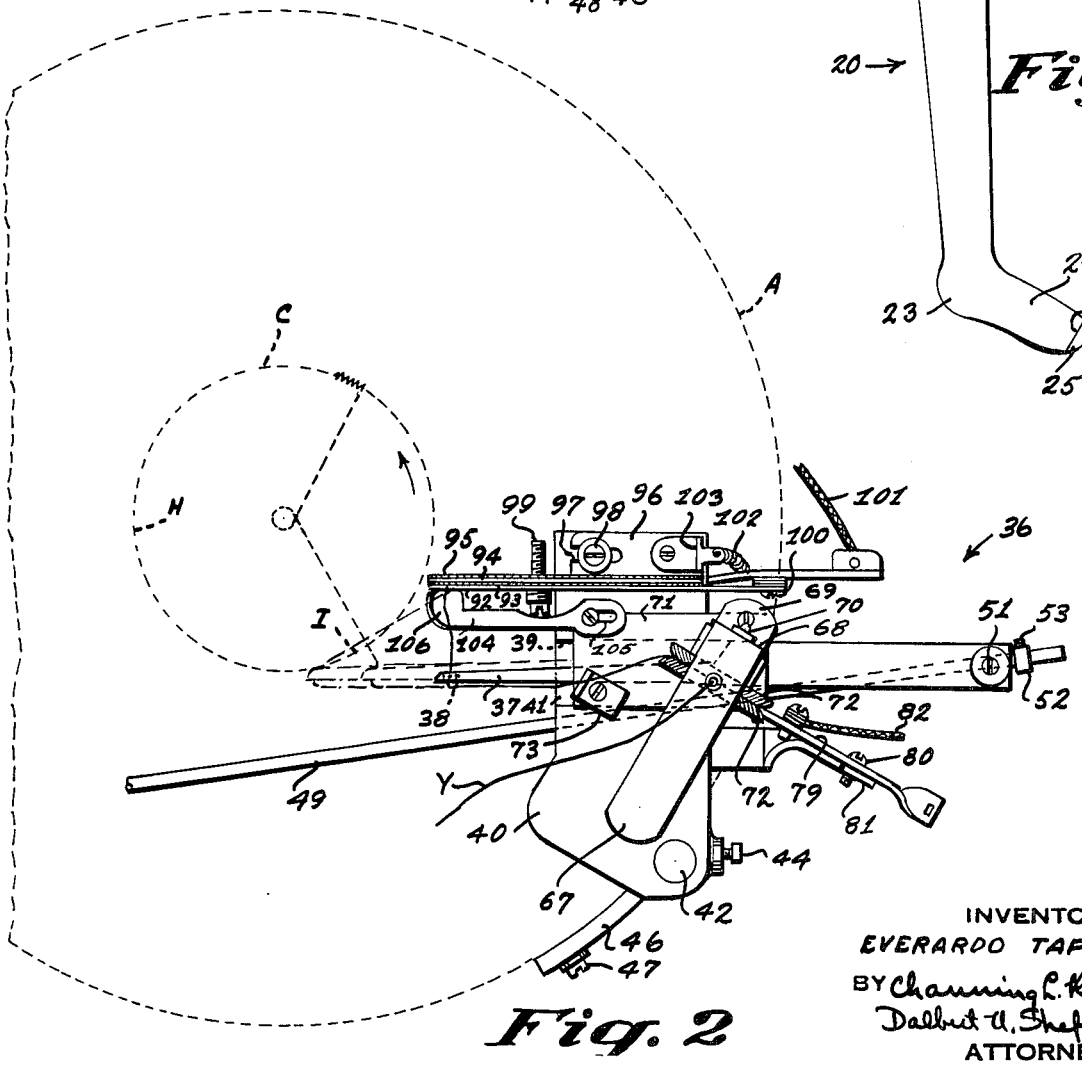
Fig. 2
INVENTOR
EVERARDO TAPIA
BY Channing L. Richards &
Dalbert A. Shefte
ATTORNEYS Fig. 3
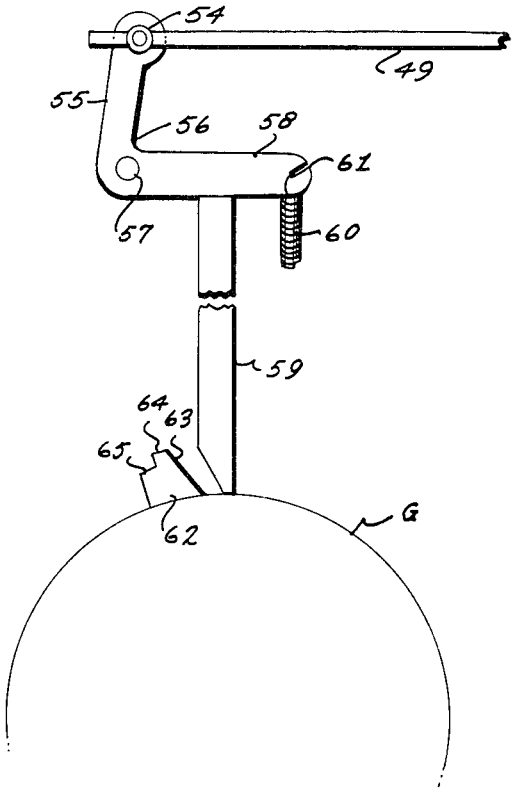
Fig. 4
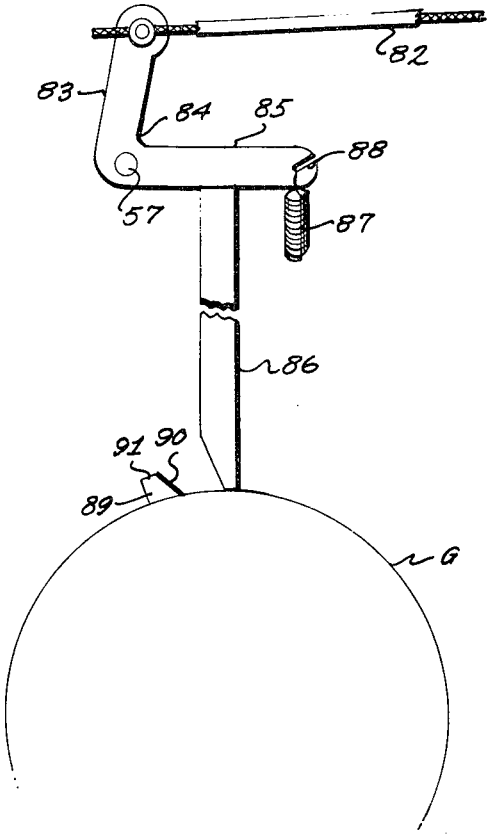
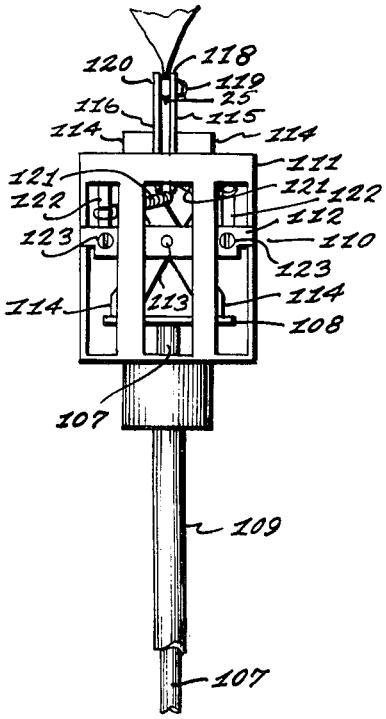
Fig. 5
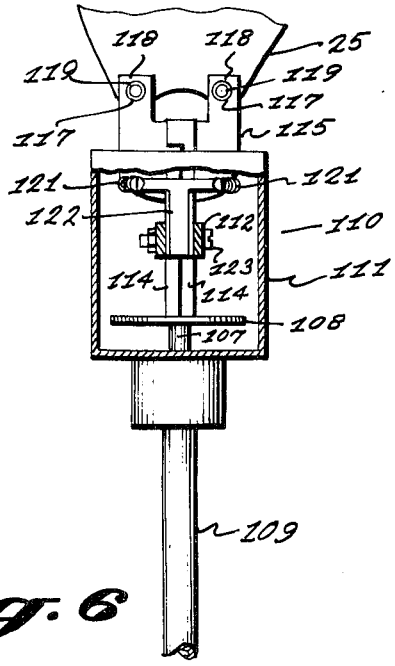
Fig. 6
INVENTOR
EVERARDO TAPIA
BY Channing L. Richards &
Dalbert U. Shafer
ATTORNEYS INVENTOR
EVERARDO TAPIA
BY Channing P. Richards &
Dalbert U. Shafer
ATTORNEYS

AUXILIARY FEED ATTACHMENT FOR A CIRCULAR KNITTING MACHINE

BACKGROUND OF THE INVENTION

The present invention relates to tubular knit fabric articles having an end of reduced tubular size, and to a method and knitting machine attachment for producing such reduced size ends in tubular knit fabric articles.

Various knit articles are manufactured with ends of reduced size to suit particular uses. For example, tubular knit hosiery is closed at the toe end. This is conventionally accomplished by either seaming or looping of the initially open toe end of the tubular hosiery blank in a separate operation after the tubular blank has been knit, which requires additional handling, equipment and processing that add significantly to the overall cost of production as compared with a closing operation that could be accomplished during knitting of the tubular blank.

A toe closing operation accomplished during the overall knitting process on a circular knitting machine is disclosed in Currier U.S. Pat. No. 3,327,500, issued June 27, 1967, which teaches the knitting of a tubular welt-like toe portion that is rotationally twisted prior to completion by effecting relative rotation between the fabric supporting dial and the needle cylinder. This twisting produces a restriction of the tubular opening in the fabric intermediate the dial and needle cylinder, which restriction is disposed as a substantially closed outer end of the toe portion when the welt-like toe portion is completed by transferring. To produce this closed end by twisting, however, it is necessary to modify significantly the construction and operation of the dial drive mechanism of the circular knitting machine, and the resulting toe portion is characterized by an undesirable twisted and bulky appearance.

In contrast, the present invention provides a substantially closed end in the toe portion of hosiery without the disadvantage of twisting and with a simple attachment that can be mounted on a circular knitting machine without modification of the existing machine parts or their operation.

SUMMARY OF THE INVENTION

The tubular knit fabric article of the present invention has an outer end of reduced tubular size to which it is confined by a length of yarn that is formed in a constricting loop or loops at the outer end between two plies of tubular fabric, to which fabric the ends of the length of yarn are secured to prevent unlooping or loosening of the constricting loop. As the reduced size is obtained only by the use of a length of yarn and as this yarn is disposed between fabric plies, this means for reducing the size is substantially inconspicuous and undetectable in sight or feel. Importantly, it can be produced during knitting of the article without independent processing and requires only the addition of a simple attachment to an existing circular knitting machine without significant modification of the machine construction and operation. Further, no twisting or other unconventional manipulation of the fabric is required to produce this reduced tubular size.

The size of the constricting loop or loops may be varied to obtain the desired size reduction and they can be made sufficiently small to close substantially the end of the fabric as at the toe end of hosiery.

The ends of the constricting loop yarn are preferably secured to the fabric of the tubular plies by being knit therein, which can be accomplished simply during the knitting of the article. Where a substantial number of constricting loops are incorporated in the article, one end of the constricting loop yarn may be knit in one of the fabric plies and the other end knit in the other fabric ply, which permits the loops to be formed simultaneously with the knitting of the plies without requiring an extension of the plies to accommodate the formation of a plurality of loops.

The two ply construction of the end portion of the article provides desirable strength thereat, and is preferably formed as a reverse fold of the fabric of the article. This may be a welt-like formation with the plies joined at their inner end by knit stitches.

The reduced tubular size of the end of a knit fabric article is produced according to the method of the present invention by knitting an initial portion, knitting a plurality of courses to form a length of tubular fabric while supporting the portion above the level of knitting, looping a yarn under tension around this length of fabric while the initial portion is supported to form a constricting loop or loops that confine the portion of the fabric thereat to a reduced tubular size, and knitting a subsequent course of fabric with the initial portion knit therein to form a two ply fabric construction with an end at which the constricting loop or loops are disposed between the plies. Sufficient tension is applied to the looping yarn to obtain the desired size reduction, which may substantially close the tubular fabric as in the case of the toe of hosiery. When a plurality of constricting loops are being formed a relatively light tension is applied initially to avoid a breaking strain on the looping yarn and to allow a shifting of the fabric in the initial loops; the tension is then increased to obtain the desired degree of constriction.

In this method, the ends of the looping yarn are secured to the tubular fabric by securing the leading end to the tubular fabric prior to looping and securing the trailing end to the tubular fabric subsequent to looping, and the securing is preferably accomplished by knitting of the ends in the tubular fabric during the knitting of the fabric. In the preferred embodiment, the trailing end of the looping yarn is cut outwardly of the fabric following looping to form an extending tail that is subsequently knit in the tubular fabric.

The method of the present invention is advantageous in that it can be practiced without interruption of the continuous knitting of the tubular fabric and without modification of the machine elements that perform the tubular knitting operation. Further, it is simple and is easily performed with the use of an auxiliary yarn feeding attachment on a conventional circular knitting machine.

The reduced tubular size of the end of a knit fabric article is produced by the foregoing method using an auxiliary yarn feeding attachment of the present invention, which is an attachment for a circular knitting machine of the type that knits a welt-like fabric portion by supporting an initial portion of the fabric above the knitting level until the welt-like portion is completed by knitting the initially supported portion with a subsequent course of the fabric. This attachment includes an auxiliary yarn feeding member that is movably mounted on the circular knitting machine adjacent the needle circle thereof, and means for selectively positioning the auxiliary yarn feeding member sequentially in an inoperative withdrawn position at which it retains an auxiliary yarn in a non-feeding disposition, a feeding position at which the auxiliary yarn is fed temporarily to the needle circle for knitting in the welt-like fabric portion, and an intermediate position at which the auxiliary yarn is positioned out of knitting engagement with the needle circle and is drawn by the previously knit portion thereof in a constricting loop or loops around the welt-like fabric portion prior to completion thereof, thereby reducing the tubular size of the welt-like fabric portion at the constricting loop or loops.

The attachment includes means for applying tension to the auxiliary yarn to form the constricting loop to a desired size, and in the preferred embodiment this means is operable to apply a relatively light tension during formation of initial constricting loops and an increased tension to form subsequent tight loops, which may be tight enough to close substantially the welt-like tubular fabric thereat.

In the preferred embodiment, the auxiliary feeding member is disposed to engage the auxiliary yarn in the needle circle for knitting in the welt-like fabric portion as the member is moved to its inoperative withdrawn position following formation of the constricting loop or loops. Also, clamping and cutting means is provided adjacent the needle circle and spaced from the auxiliary yarn feeding member in the direction of needle circle rotation for holding the leading end of the auxiliary yarn for engagement with the needle circle when the auxiliary yarn feeding member moves to the feeding position, then to release the auxiliary yarn and subsequently to engage and cut the trailing end of the auxiliary yarn during movement of the auxiliary yarn feeding member to its inoperative withdrawn position, which cut trailing end extends as a tail from the needle circle and is carried thereby for subsequent knitting in the welt-like fabric portion.

As the fabric is reduced in tubular size by the constricting loop or loops it is not easily engaged by conventional fabric take-down means during subsequent knitting of the fabric article. For this reason the attachment of the present invention includes take-down means having a pair of jaws opening upwardly for engaging and clamping the welt-like fabric portion following completion of the knitting thereof, one of the jaws having an aperture therein and the other having a projection thereon aligned with the aperture for extension therein upon closing of the jaws to clamp the fabric in the aperture, and means for moving the clamping jaws to apply a take-down pull on the clamped fabric.

BRIEF DESCRIPTION OF THE DRAWINGS

FIG. 1 is an elevational view of the preferred embodiment of the auxiliary yarn feeding attachment of the present invention with portions of a circular knitting machine on which the attachment is mounted shown in light lines, and with the fabric take-down means partially broken away;

FIG. 2 is a plan view of the auxiliary yarn feeding attachment of FIG. 1;

FIG. 3 is an elevational view, partially broken away, of the auxiliary yarn feeding member control mechanism of the attachment of FIG. 1;

FIG. 4 is an elevational view, partially broken away, of the auxiliary yarn tensioning control mechanism of the attachment of FIG. 1;

FIG. 5 is an elevational view of the take-down means of the attachment of FIG. 1, showing the jaws in closed fabric clamping disposition;

FIG. 6 is a partially broken away elevational view of the take-down means of FIG. 5 as viewed from one side of FIG. 5;

FIG. 19 is an elevational view, on a reduced scale, of a tubular knit hosiery article according to the preferred embodiment of the present invention.

DESCRIPTION OF THE PREFERRED EMBODIMENT

Figure 7:
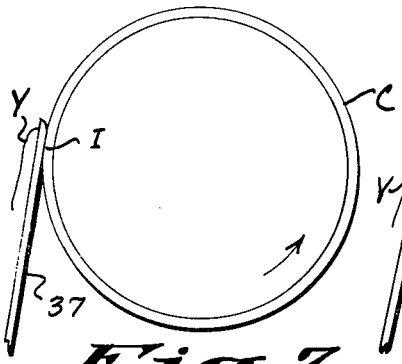
FIGS. 7–16 are diagrammatic illustrations of the progressive stages of the manufacture of tubular knit hosiery according to the preferred embodiment of the method of the present invention.

For the purpose of providing a detailed disclosure, the preferred embodiment of the present invention is hereinafter described in detail in relation to the toe portion of ladies' seamless hosiery and a circular knitting machine of the type used to knit such hosiery. It is to be understood, however, that the present invention is applicable as well to other types of hosiery articles, to other types of tubular knit fabric articles, and to other types of circular knitting machines.

An article 20 of ladies' seamless hosiery according to the preferred embodiment of the present invention is illustrated in FIG. 19. This hosiery article 20 generally resembles conventional hosiery, having a welt 21 at the top, a leg portion 22 extending from the welt 21 to a heel portion 23, and a foot portion 24 extending from the heel portion 23 to a toe portion 25.

Figure 17:
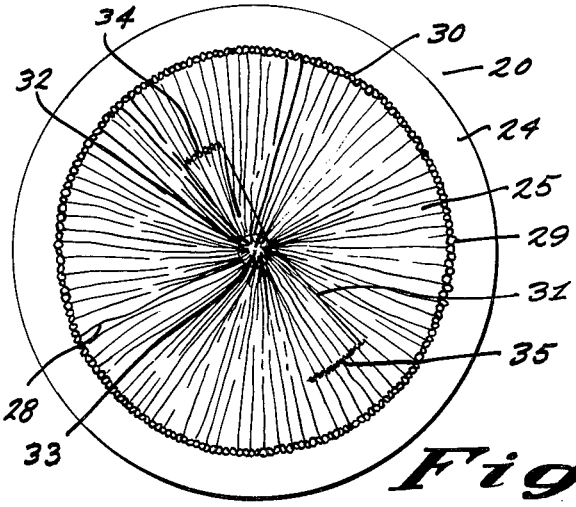
FIG. 17 is an end view of a completed toe portion of a tubular knit hosiery article according to the preferred embodiment of the present invention.
Figure 18:
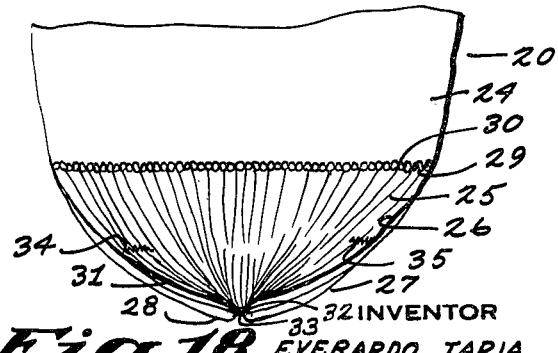
FIG. 18 is an elevational view of the hosiery toe portion of FIG. 17.

The present invention is directed particularly to the toe portion 25, which is illustrated in detail in FIGS. 17 and 18. This toe portion 25 is of a two ply welt-like construction, having an inner ply 26 of tubular knit fabric and an outer ply 27 of tubular knit fabric. The outer ply 27 is a continuation of the tubular knit fabric of the inner ply 26 reversely folded at the outer end 28 of the toe portion 25 so that the plies are continuously joined annularly at the outer end 28. At the inner end 29 of the toe portion 25 the inner ply 26 is continuously joined annularly to the outer ply 27 by a course of knit transfer stitches 30. Thus, this two ply construction resembles the welt construction conventionally provided at the top of ladies' hosiery, with foot portion 24 formed as a single ply continuation of the tubular fabric of the outer ply 27.

The outer end 28 of this two ply toe portion 25 is closed by a length of auxiliary yarn 31 disposed between the tubular plies 26 and 27 and formed in a plurality of constricting loops 32 at the outer end 28 of the toe portion 25, thereby confining the plies to a reduced tubular size at the outer end. In the embodiment illustrated, these constricting loops are tightly formed in small loops that substantially close the tubular opening 33 at the outer end of the plies, and thereby provide the toe portion 25 with a closed outer end 28.

The length of auxiliary yarn 31 is retained in its constricting loop formation by having its leading end 34 knit in the fabric of the inner ply 26 for a few stitches, and its trailing end 35 knit in the fabric of the outer ply 27 for a few stitches, with the stitches of the ends 34 and 35 spaced inwardly from the outer end 28 and outwardly from the inner end 29 of the toe portion 25. To assure securement of the ends of the auxiliary yarn in the ply fabric, the ends are knit therein for at least 5, and preferably 10 or more, stitches. Securement of the auxiliary yarn, as well as retention of loop tightness, is also enhanced by using a cotton yarn, which does not slip as easily as nylon. Preferably, a 40 denier cotton yarn is used, and it is formed in 24 to 36 constricting loops. However, the type and size of yarn, the number of constricting loops and the number of securing stitches may be varied to obtain any desired results.

Hosiery having the above-described closed toe construction may be produced on any conventional circular knitting machine capable of forming turned welts by a transferring operation, and to which the auxiliary yarn feeding attachment of the present invention is adaptable. Other than adapting this attachment to the knitting machine, it is only necessary to reverse the patterning sequence to knit the toe portion first and the top welt last and to knit the toe in a welt-like pattern. Such a machine and patterning modification, without the attachment of the present invention, are disclosed and described in the aforementioned Currier U.S. Pat. No. 3,327,500, that additionally discloses means for twisting the welt-like toe portion, which is not necessary or desirable to incorporate in a machine to practice the present invention.

The auxiliary yarn feeding attachment 36 of the present invention is illustrated in FIGS. 1–6 on a two feed Scott and Williams Model KN2 circular knitting machine. As the knitting machine is of conventional construction, only the portions of the machine that have a relation to the attachment of the present invention are disclosed herein, and these portions are only diagrammatically illustrated. Thus, FIGS. 1–6 include an illustration of the fixed bed plate A that surrounds the rotating needle cylinder B at the top of which needles are carried in a needle circle C for rotation in a needle wave D to accomplish knitting in conjunction with sinkers manipulated in a sinker cap E and transfer jacks manipulated in a transfer dial F, with the knitting pattern controlled by a pattern drum G. As this is a two feed machine, the needle wave D has two spaced stitch points H and I to which the wave descends to draw the yarn fed to the descending needles into knit stitches. The transfer jacks are manipulated in the transfer dial F to receive yarn and form transfer loops that are retained on the transfer jacks above the knitting level of the stitch points H and I as knitting continues until a desired length of fabric has been knit to form a welt-like portion of fabric, following which the transfer jacks are manipulated to transfer the retained loops onto the needles to form a transfer course that completes the formation of a welt-like portion.

The attachment 36 includes a horizontally disposed auxiliary yarn feeding member 37 that is movable linearly along a horizontal line generally tangent to the needle circle C at a point on the descent of the needle wave D in advance of and above the level of the stitch point I for feeding of an auxiliary yarn Y to the needle circle C for knitting at the stitch point I through a yarn guiding aperture 38 at the end of the member 37 adjacent the needle circle C. This auxiliary yarn feeding member 37 is supported for linear sliding in a groove 39 formed in a base plate 40 and is retained in the groove 39 by a cover plate 41 secured to the top of the base plate 40 in covering relation over the groove 39 and auxiliary yarn feeding member 37.

The base plate 40 is mounted on an upstanding post 42 that extends into a collar portion 43 of the base plate 40, with a set screw 44 extending through the collar portion 43 for engagement with the post 42 to secure the base plate 40 thereto while permitting vertical and angular adjustment to position the yarn feeding member 37 in proper operating disposition with respect to the needle wave D.

The post 42 is secured at its lower end in a foot plate 45 that is supported on the bed plate A of the knitting machine and has a depending arcuate flange 46 secured to the side of the circular bed plate A by scews 47 that extend through elongated slots 48 in the flange 46, which slots 48 permit further adjustment of the position of the auxiliary yarn feeding member 37.

Manipulation of the auxiliary yarn feeding member 37 is accomplished by means that selectively position the member sequentially in an inoperative withdrawn position, an advanced feeding position, and an intermediate position. In the inoperative withdrawn position, shown in solid lines in FIGS. 1 and 2, the auxiliary yarn feeding member 37 retains the auxiliary yarn Y in a non-feeding disposition. In the feeding position, shown in light dot-dash lines as the farthest left projection of the member in FIGS. 1 and 2, the member feeds the auxiliary yarn temporarily to the needle circle C for knitting. In the intermediate position, shown in light dot-dash lines between the withdrawn and advanced positions in FIGS. 1 and 2, the member 37 positions the auxiliary yarn Y out of knitting engagement with the needle circle C so that the yarn is drawn by the previously knit portion in constricting loops around the welt-like fabric that is supported between the needle circle C and the transfer dial F, thereby reducing the tubular size of the fabric portion at the constricting loops.

This means for selectively positioning the auxiliary yarn feeding member 37 includes an operating rod 49 having one end extending through a depending arm 50 that is secured by a screw and washer set 51 to the member 37 at the end of the outward extension thereof from the base plate 40, with the screw and washer set 51 permitting rotational movement of the depending arm 50 to accommodate slight relative angular deviations of the operating rod 49 in its different operating positions. The operating rod 49 is fixed to the depending arm 50 for operation of the auxiliary yarn feeding member 37 by a pair of collars 52 secured by set screws 53 to the operating rod 49 on opposite sides of the depending arm 50.

The operating rod 49 extends generally horizontally to a location above the pattern drum G (FIG. 3) at which location its end is pivotally secured through a mounting pin 54 to an upwardly extending arm 55 of an operating rod bell crank 55 that is pivotally mounted on a supporting shaft 57. The other arm 58 of this bell crank 56 extends generally horizontally toward the auxiliary yarn feeding member 37 and has a depending control finger 59 that extends downwardly into supporting contact with the surface of the pattern drum G to normally position the operating rod bell crank 56 in the position shown in FIG. 3, at which the auxiliary yarn feeding member 37 is in its inoperative withdrawn position. The bell crank 56 is biased to maintain the control finger 59 in contact with the pattern drum G by a coil spring 60 that has its upper end seated in a slot 61 in the outer end of the horizontal arm 58 of the bell crank 56 and its other end (not shown) fixed to a stationary part of the knitting machine.

The operating rod bell crank 56 is manipulated to displace the operating rod 49 by a cam 62 fixed to the pattern drum G. This cam has an initial inclined surface 63 that engages and raises the control finger 59 to pivot the bell crank 56 counterclockwise to manipulate the auxiliary yarn feeding member 37 to its advanced feeding position, at which it is maintained temporarily by support of the control finger 59 on a first generally flat surface 64 of the cam 62. This first flat surface 64 is short in relation to the timed advance of the pattern drum G so that the auxiliary yarn feeding member 37 will be maintained in its advanced feeding position only long enough to knit a few stitches, such as 5 or 10.

Immediately following this first flat surface 64 is a second generally flat surface 65 of a sufficiently lesser height than the first flat surface 64 to cause partial return of the bell crank 56 to move the auxiliary yarn feeding member 37 to its intermediate position. This second flat surface 65 extends a sufficient distance in relation to the sequential advance and dwell operation of the pattern drum G to maintain the auxiliary yarn feeding member 37 in its intermediate position during a plurality of revolutions of the needle cylinder B, such as 36 or 58 revolutions, for forming of a like plurality of constricting loops 32.

The cam 62 terminates at the end of the second flat surface 65 to permit return of the control finger 59 to the surface of the pattern drum G, which causes return of the auxiliary yarn feeding member 37 to its inoperative withdrawn position, where it remains for the remainder of the knitting cycle.

The auxiliary yarn Y is fed to the auxiliary yarn feeding member 37 from a supply (not shown) above the knitting machine through an eyelet 66 in a horizontal extension 67 of an upstanding mounting bracket 68 that has a foot portion 69 attached by a screw 70 to a mounting plate 71, which in turn is mounted on the aforementioned cover plate 41 over the groove 39 of the base plate 40.

This mounting bracket 68 supports means for applying tension to the auxiliary yarn Y, which means is operable to apply a relatively light tension during initial formation of constricting loops and an increased tension to form subsequent tight loops. This means for applying tension is of a generally conventional construction, having a pair of separable discs 72 rotatably mounted on a horizontal shaft 73 that is secured by nuts 74 on the upstanding mounting bracket 68 directly below the eyelet 66. The disc 72 are retained on the shaft 73 by lock nuts 75 and are normally biased together by a coil spring 76 located on the shaft 73 between the discs 72 and the lock nuts 75, this biasing applies the aforementioned increased tension on the auxiliary yarn Y as it travels between the discs 72 and under the shaft 73 to a guide eyelet 77 and ultimately to the aperture 38 of the auxiliary yarn feeding member 37. The guide eyelet 77 is formed in an eyelet bracket 78 upstandingly mounted on the mounting plate 71 between the discs 72 and the yarn feeding aperture 38 in the end of the auxiliary yarn feeding member 37, and is spaced slightly from direct alignment between the discs 72 and the aperture 38, which in conjunction with an inclination of the discs 72 to such direct alignment imposes at least a light tensioning drag on the auxiliary yarn Y when the discs 72 are separated.

Separation of the discs 72 to relieve the aforementioned increased tension and allow the auxiliary yarn Y to feed under light tension is accomplished by a separating blade 79 pivotally mounted by a screw 80 to an upstanding mounting bar 81 that has its lower end secured to the bed plate A. This separating blade 79 is disposed for pivoting in the plane of the disc faces between an inoperative position out of disc contact, as seen in FIGS. 1 and 2, and an operative position between the discs faces, in which operative position the thickness of the blade 79 separates the discs 72 to relieve the tensioning drag imposed on the auxiliary yarn Y by the biased discs 72.

The separating blade 79 is manipulated by a Bowden wire 82 that has one end connected to the separating blade 79 between the pivot screw 80 and the yarn tensioning discs 72, and its other end connected to the upstanding arm 83 of a bell crank 84 that is pivotally mounted above the pattern drum G on the aforementioned supporting shaft 57 on which the operating rod bell crank 56 is mounted. The other arm 85 of the Bowden wire bell crank 84 extends generally horizontally toward the tensioning discs 72 and has a depending control finger 86 that extends downwardly into supporting contact with the surface of the pattern drum G to normally position the Bowden wire bell crank 84 in the position shown in FIG. 4, at which the disc separating blade 79 is in its inoperative position. The bell crank is biased to maintain the control finger 86 in contact with the pattern drum G by a coil spring 87 that has its upper end seated in a slot 88 in the other end of the horizontal arm 85 of the bell crank 84 and its other end (not shown) fixed to a stationary part of the knitting machine.

The Bowden wire bell crank 84 is manipulated to pivot the separating blade 79 to its operative tension relieving position between the discs 72 by a cam 89 fixed to the pattern drum G. This cam has an initial inclined surface 90 that engages and raises the control finger 86 to pivot the bell crank 84 counterclockwise to manipulate the separating blade 79 to its operative position at which it is maintained by an outer generally flat surface 91 of the cam 89 that immediately follows the inclined surface 90. This flat cam surface 91 is located on the pattern drum G in relation to the operating rod control cam 62 so as to manipulate the separating blade 79 to relieve yarn tension at the same time or shortly after the auxiliary yarn feeding member 37 is manipulated to its advance feeding position, and to so maintain the separating blade 79 until the auxiliary yarn feeding member has been moved to its intermediate position and a few relatively loose constricting loops have been formed, at which time the flat surface 91 of the cam 89 will move out of engagement with the control finger 86, allowing the Bowden wire bell crank 84 to return to its initial position, thereby manipulating the separating blade 79 to its inoperative position and allowing the discs 72 to impose an increased tension on the auxiliary yarn Y.

Auxiliary yarn clamping and cutting means is provided to hold the leading end of the auxiliary yarn Y during movement of the auxiliary yarn feeding member 37 to its advanced feeding position for extension of the yarn from the clamping and cutting means into engagement with the needle circle C to initiate knitting. The clamping and cutting means then releases the yarn and subsequently, during movement of the auxiliary yarn feeding member 37 from its intermediate position to its inoperative withdrawn position, cuts the yarn to release the trailing end while clamping the subsequent leading end preparatory to repeating the cycle.

This clamping and cutting means is a generally conventional mechanism that is disposed outwardly adjacent the needle circle C and spaced from the auxiliary yarn feeding member 37 in the direction of needle circle rotation. It has a series of mating blades each extending generally parallel to the auxiliary yarn feeding member 37, and comprising in sequence, beginning with the blade closest to the auxiliary yarn feeding member, a stationary clamping blade 92, a movable clamping blade 93, a stationary cutting blade 94 and a movable cutting blade 95. The movable clamping blade 93 cooperates with the stationary clamping blade 92 and the stationary cutting blade 94 to clamp the auxiliary yarn Y therebetween, and the movable cutting blade 95 cooperates with the stationary cutting blade 94 to cut the auxiliary yarn Y outwardly of the clamped portion of the yarn. The stationary blades 92 and 94 are mounted on a supporting plate 96 that has a slot 97 for adjustable attachment to the aforementioned base plate 40 by a screw 98 received in the slot 97. The movable blades 93 and 95 are pivotally attached to the stationary blades 92 and 94 by a pivot screw 99 for vertical scissors action and extend outwardly and upwardly therefrom to a location where they are connected for cooperative action by a connecting screw 100. The movable cutting blade 95 extends beyond the connecting screw 100 for attachment thereto of one end of a Bowden wire 101 that has its other end manipulated from the patter chain of the knitting machine to operate the movable blades 93 and 95 between a closed position, shown in solid lines in FIG. 1, and an open position, shown in dot-dash lines in FIG. 1, with the movable blades 93 and 95 normally biased in their closed position by a coil spring 102 that has one end connected to the upper end of a supporting rod 103 above the blades and its other end connected to the movable cutting blade 95 adjacent the connecting screw 100. The spring supporting rod 103 is mounted at its lower end on the aforementioned base plate 40.

All of the clamping and cutting blades 92, 93, 94 and 95 extend closely adjacent the needle circle C for cutting of the auxiliary yarn close to the needle circle C and for clamping the yarn close to the needle circle C so that the clamped yarn will engage the needle circle when the auxiliary yarn feeding member 37 is in its advanced feeding position, and the yarn is guided to the blades by a guide plate 104 that is adjustably mounted on the base plate 40 by a slot and screw connection 105 and extends closely adjacent the needle circle alongside the stationary clamping blade 92. The portion 106 of the guide plate 104 adjacent the needle circle C is inclined downwardly toward the needle circle to a level sufficiently low to assure engagement of the yarn extending between the needle circle C and the auxiliary yarn feeding member 37 as this member moves to its inoperative withdrawn position, so as to guide the yarn to the clamping and cutting blades, which are open during this portion of the operation and are closed immediately subsequent to receipt of the yarn to effect cutting of the yarn end extending from the needle circle C and clamping of the yarn end extending from the auxiliary yarn feeding member 37. The blades remain in clamping position until the yarn is again engaged in the needle circle C following the next advance of the auxiliary yarn feeding member 37, at which time the blades open to release the previously clamped yarn end.

As the preferred embodiment of the attachment of the present invention functions to form the auxiliary yarn Y in constricting loops 32 that substantially close the outer end 28 of the hosiery article 20 with the closed outer end 28 being the initially knit portion of the article, there is no open end of fabric for a conventional mechanical take-down device to engage. Therefore, the attachment of the present invention includes a unique take-down means that may be included when the attachment is adapted to a knitting machine having a conventional mechanical take-down device, but which is not necessary for machines having pneumatic take-down devices as pneumatic take-down devices are not restricted for effective operation to an open ended fabric.

This fabric take-down means of the attachment of the present invention utilizes the existing conventional manipulating mechanisms and functions from the same pattern controls as the conventional mechanical take-down devices. In this regard, it utilizes the existing operating rod 107, disc 108 secured to the upper end of the operating rod 107, and tubular sleeve 109 slidable on the operating rod 107 of the conventional mechanical take-down device. The only difference is in the construction and operation of the clamping head 110, which in the preferred embodiment includes a cup-like frame 111 fixed to the upper end of the tubular sleeve 109 and extending upwardly substantially beyond the disc 108 that is fixed to the top of the operating rod 107. Mounted across the cuup-like frame 11 above the disc 108 are a pair of spaced horizontal support bars 112 that are connected at the center of the head 110 by a horizontal pivot pin 113 on which are pivotally supported a pair of scissors arms 114 that have their lower ends in engagement with the disc 108 for opening and closing of the arms 114 by relative vertical movement of the operating rod 107 with respect to the head 110. Secured to the upper ends of the scissors arms 114 for movement therewith are bifurcated flat clamping jaws 115 and 116 disposed in face-to-face clamping relation above the cup-like frame 111. One clamping jaw 115 has an aperture 117 formed in each of the upwardly extending bifurcated portions 118 adjacent the upper ends thereof, and the other clamping jaw 116 has a stud-like projection 119 formed on each of the upwardly extending bifurcated portions 120 in alignment with the opposing apertures 117 for extension therein upon closing of the jaws 115 and 116.

The clamping jaws 115 and 116 are normally urged toward a closed disposition, which biases the lower ends of the scissors arms 114 against the disc 108, by coil springs 121 that extend between the clamping jaws 115 and 116 and opposed mounting posts 122 secured by screws 123 to and upstanding from the support bars 112 oppositely outward of the scissors arms 114.

The disc 108 is normally in a relatively lower position with respect to the clamping head 110, as shown in FIGS. 5 and 6, in which position the clamping jaws 115 and 116 are closed with the projections 119 extending into the apertures 117. Opening of the jaws 115 and 116 occurs at the beginning of a take-down cycle when the clamping head 110 is disposed in its raised position immediately under the initially knit fabric and the disc 108 is raised by the operating rod 107 by conventional operating means to spread the jaws for receiving fabric therebetween so that upon subsequent relative lowering of the disc 108 the fabric will be engaged by the projections 119 and firmly clamped thereby in the apertures 117 during the subsequent take-down stroke. At the lower end of the take-down stroke the disc 108 is again raised relative to the clamping head 110, causing the jaws 115 and 116 to open and release the fabric for discharge from the knitting machine.

The above-described attachment of the present invention operates in relation to the operation of the knitting machine to which it is attached to practice the method of the present invention in knitting hosiery having toe ends that are closed during the knitting operation. At the beginning of the knitting cycle the attachment is inactive, with the auxiliary yarn feeding member 37 in its inoperative withdrawn position and the auxiliary yarn Y extending therefrom to the clamping and cutting blades 92, 93, 94 and 95, which hold the auxiliary yarn out of knitting engagement with the needle circle C. The cycle begins conventionally by knitting of a make-up with a course of an initial portion in the form of transfer stitches 30 supported on the jacks of the transfer dial F, which jacks retain the course of transfer stitches 30 out of needle engagement above the knitting level as knitting continues to knit a length of tubular fabric produce the welt-like toe portion 25. As the knitting machine is a two feed machine, two courses of fabric are knit during each revolution of the needle cylinder B. As a typical example, the toe portion 25 is knit during 84 needle cylinder revolutions, forming a toe portion having 168 knit courses.

Immediately prior to completion of the knitting of about 48 courses of the toe portion 25 by 24 revolutions of needle cylinder B, tension of the auxiliary yarn Y is reduced to a relatively light tension. This results from the pattern drum G having advanced the yarn tension control cam 89 (FIG. 4) sufficiently for the control finger 86 to have been raised by the inclined cam surface 90 into engagement with the flat cam surface 91, in which position the control finger has pivoted the bell crank 84 counterclockwise to cause the Bowden wire 82 to move the separating blade 79 between the yarn tensioning discs 72 and thereby relieve the auxiliary yarn Y of the tension of the discs 72.

Figure 8:
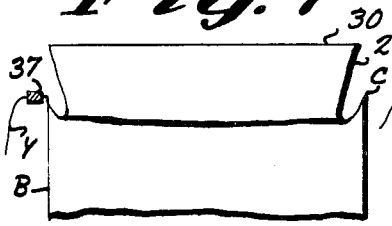

Immediately following this reduction of tension on the auxiliary yarn Y and at about the 24th needle cylinder revolution, the pattern drum G has advanced the control cam 62 (FIG. 3) sufficiently for the control finger 59 to have been raised by the inclined cam surface 63 into engagement with the first flat cam surface 64, which results in the bell crank 56 being pivoted counterclockwise to cause the operating rod 49 to position the auxiliary yarn feeding member 37 in its advanced feeding position, as shown diagrammatically in FIGS. 7 and 8. At this point the leading end 34 of the auxiliary yarn Y remains clamped by the clamping and cutting blades 92, 93, 94 and 95 so that it extends, as shown in FIG. 2, between the blades and auxiliary yarn feeding member aperture 38 into engagement with the needle circle C in advance of the stitch point I, causing the auxiliary yarn to be engaged by the needles as they descend to the stitch point I, and resulting in the auxiliary yarn being knit in the fabric.

At this point, the pattern chain manipulates the Bowden wire 101 to pivot the movable clamping and cutting blades 93 and 95 to open the clamping and cutting blades 92, 93, 94 and 95, which thereby release the leading end 34 of the auxiliary yarn Y for subsequent movement with the needle circle C.

Figure 9:
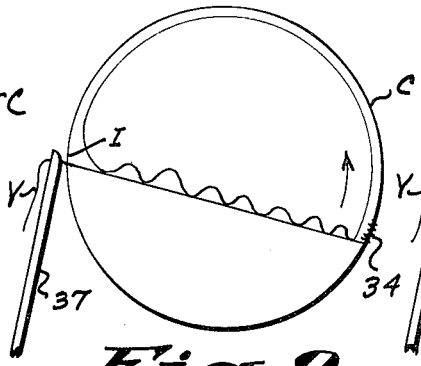
Figure 10:
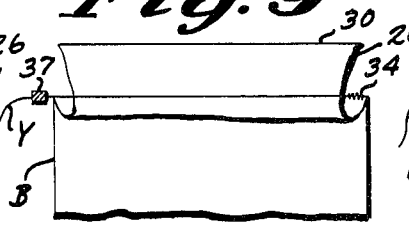

The auxiliary yarn feed member 37 is maintained in its advanced feeding position for only a short dwell period that is long enough to feed the auxiliary yarn Y to about 10 needles for knitting. The pattern drum G then advances the control cam 62 to allow the control finger 59 to drop to the second flat cam surface 65, which results in a clockwise pivot of the bell crank 56 that moves the operating rod 49 to shift the auxiliary yarn feeding member 37 to its intermediate yarn feeding position, as shown diagrammatically in FIGS. 9 and 10, at which the auxiliary yarn Y is out of needle engagement due to the descent of the needle wave D to the stitch point I below the level of the auxiliary yarn feeding member 37, which is adjacent the stitch point I in its intermediate position. The leading end 34 of the auxiliary yarn Y, being knit in the fabric, is carried by the fabric and needles around the needle wave D and thereby draws the yarn directly from the auxiliary yarn feeding member 37 across the needle circle C and into contact with the length of previously knit fabric that depends from the transfer dial F, drawing the fabric centrally away from the needle circle C (FIGS. 9 and 10). As the knit leading end 34 continues around the needle circle C it forms the auxiliary yarn Y about the depending fabric in a constricting loop formation. This continues for several revolutions of the needle circle C with the yarn being drawn by the rotating fabric into a plurality of loops that draw the depending fabric at the loops into a small central area.

The tension on the auxiliary yarn Y is then increased by movement of the cam 89 (FIG. 4) by the pattern drum G out of supporting engagement of the control finger 86, which allows the control finger 86 to drop onto the pattern drum G to pivot the bell crank 84 clockwise, thereby manipulating the Bowden wire 82 to allow the separating blade 79 (FIGS. 1 and 2) to move away from the tensioning discs 72 so that the discs 72 are urged together to apply an increased tension to the auxiliary yarn Y.

Figure 11:
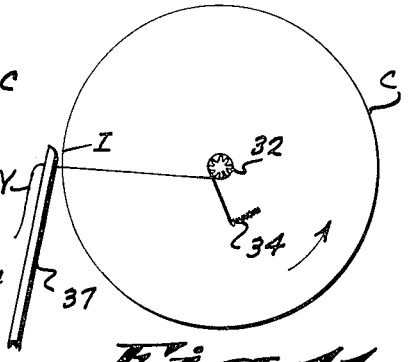
Figure 12:
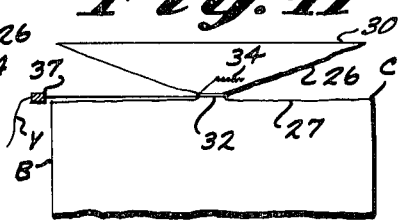

The forming of constricting loops by rotation of the needle circle with the auxiliary yarn feeding member 37 in its intermediate position continues for a plurality of revolutions with the increased tension on the yarn Y causing formation of tightly constricting loops 32 that substantially close the tubular opening in the depending fabric. During this time the two feed knitting of the fabric continues at the rate of two courses for every needle circle revolution and constricting loop formation, and as the courses are knit the knit leading end 34 of the auxiliary yarn Y advances from the needle circle with the fabric in which it is knit, ultimately moving through and above the constricting loops 32, as shown diagrammatically in FIGS. 11 and 12, to become part of the fabric of what will be the outer ply 27 of the welt-like toe portion 25 of the finished article 20 (FIGS. 17, 18 and 19).

Figure 13:
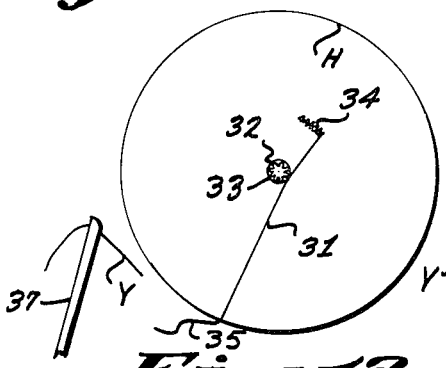
Figure 14:
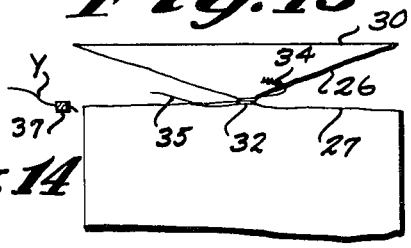

After the auxiliary yarn feeding member 37 has been positioned in its intermediate position for a total of about 48 needle circle revolutions, during which 48 constricting loops and 96 knit fabric courses have been formed, it is moved to its withdrawn inoperative position to discontinue the formation of constricting loops. This movement is obtained by the pattern drum G advancing the cam 62 (FIG. 3) out of supporting engagement of the control finger 59 so that the control finger 59 drops onto the pattern drum G, rocking the bell crank 56 clockwise to manipulate the operating rod 49 to move the auxiliary yarn feeding member to its inoperative withdrawn position. At this time the auxiliary yarn Y extends from the constricting loops 32 to the auxiliary yarn feeding member aperture 38 across the needle circle C at a point where the yarn intersects the needles as they ascend the needle wave D after passing the stitch point I. The auxiliary yarn Y is thus engaged between needles that carry the yarn around the needle circle without knitting until the yarn extending from the needle circle C to the auxiliary yarn feeding member aperture 38 is guided by the guide plate 104 into the clamping and cutting blades 92, 93, 94 and 95, which are held open at this time by the action of the pattern chain on the Bowden wire 101. The pattern chain then manipulates the Bowden wire 101 to cause the movable clamping and cutting blades 93 and 95 to close, thereby cutting the unknit end 35 of yarn trailing from the needle circle C, as shown diagrammatically in FIGS. 13 and 14, and clamping the end of yarn extending from the auxiliary yarn feeding member 37, which is thereby held in proper position in readiness for the next knitting cycle.

Figure 15:
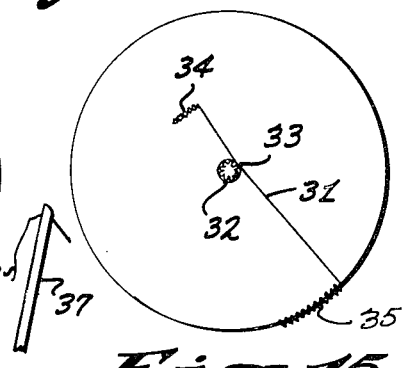
Figure 16:
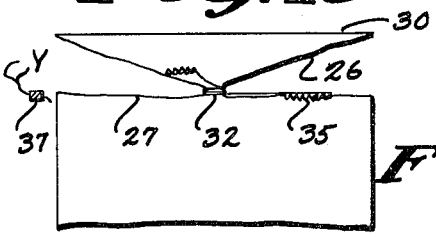

The trailing yarn end 35 is carried around the needle circle C by the needles until it reaches the next stitch point H of the needle wave D, at which it is knit by the needles into the fabric and remains therewith as knitting of the fabric continues, as shown diagrammatically in FIGS. 15 and 16. The part of the fabric in which this trailing yarn end 35 is knit becomes the inner ply 26 of the welt-like toe portion 25 of the completed hosiery article 20 (FIGS. 17, 18 and 19).

Knitting then continues after this knitting of the trailing yarn end 35 for about 12 needle cylinder revolutions to produce 24 courses of two feed knit fabric, following which the course of transfer stitches 30 is transferred from the transfer jacks to the knitting needles in a conventional manner to knit the transfer course into the fabric to complete the welt-like toe portion 25 (FIG. 18), with the length of auxiliary yarn 31 that has been cut from the supply of auxiliary yarn Y and formed in constricting loops 32 being disposed between the inner and outer fabric plies 26 and 27, respectively.

Following completion of the toe portion 25, knitting continues with the foot portion 24 being knit next, during the first part of which the take-down means, which at this time is in its raised position (FIG. 1) immediately below the needle circle C, is operated by relative upward movement of the operating rod 107 to raise the disc 108, which forces the engaged lower ends of the scissors arms 114 upwardly and apart, thereby opening the clamping jaws 115 and 116 to receive the toe portion fabric 25 that is now depending from the needle circle C. The operating rod 107 is then lowered to allow the scissors arms 114 to close and thereby clamp the jaws 115 and 116 together with the fabric of the toe portion 25 therebetween and with the stud-like projections 119 on the one clamping jaw 116 forcing the engaged fabric into the apertures 117 in the other clamping jaw 115 to securely clamp the fabric in the jaws.

The jaws 115 and 116 are maintained in fabric clamping disposition as knitting continues in the formation of the foot portion 24, heel portion 23, leg portion 22, and welt portion 21, with the clamping head 110 being lowered in a conventional manner as this knitting progresses to maintain a take-down pressure on the fabric. At the end of the knitting cycle, after the welt portion 21 has been completed by a transfer operation and a few final courses have been knit to provide a run barrier, the completed hosiery article 20 is cast off the needles and drops through the needle cylinder B. At this time the operating rod 107 is again raised with respect to the clamping head 110, which is in its lowered position, thereby opening the clamping jaws 115 and 116 and releasing the previously clamped toe portion fabric 25 so that the hosiery article 20 can be discharged from the knitting machine as by conventional pneumatic means.

The hosiery article 20 produced according to the above-described preferred embodiment of the present invention has its toe portion 25 substantially closed at its outer end 28 by the tight constricting loops 32 of the length 31 of auxiliary yarn Y. There is, however, a very small opening 33 that is insignificant in relation to the use of the article 20 as hosiery. This opening 33 may be increased if desired for appearance variations simply by decreasing the tension applied to the auxiliary yarn Y during the formation of the constricting loops 32. Further, the leading end 34 and trailing end 35 of length 31 of auxiliary yarn Y may be secured to the hosiery fabric in other knitting operations or in a non-knit securement, or may be left unsecured where the constricting loops will otherwise retain their constricting configuration.

Although the present invention has been described in its preferred embodiment in relation to hosiery articles, it is applicable as well to other knit articles and their manufacture where it is desired to form an article to a closed or restricted tubular size.

Also, the invention is not restricted to the particular knitting machine mentioned hereinabove as any other circular knitting machine for knitting seamless hosiery can be used where the described attachment or a variation thereof can be incorporated. In this regard, the present invention is not restricted to the use of a two feed machine as a single feed, four feed, eight feed or other plurality feed machine could be used. Similarly, the invention can be utilized with circular knitting machines of various types, other than hosiery machines, for knitting various other types of articles.

Thus, it is to be understood that the present invention is susceptible of variation beyond the described preferred embodiment and is not intended to be limited by the foregoing detailed description, which has been set out for purposes of illustration only, or otherwise, except as defined in the appended claims.

I claim:

1. An auxiliary yarn feeding attachment for a circular knitting machine of the type that knits a welt-like fabric portion by supporting an initial portion of the fabric above the knitting level until the welt-like portion is completed by knitting the initially supported portion with a subsequent course of the fabric, said attachment comprising an auxiliary yarn feeding member movably mounted on said circular knitting machine adjacent the needle circle thereof, means for selectively positioning said auxiliary yarn feeding member sequentially in an inoperative withdrawn position at which it retains an auxiliary yarn in a non-feeding disposition, a feeding position at which the auxiliary yarn is fed temporarily to the needle circle for knitting in said welt-like fabric portion, and an intermediate position at which the auxiliary yarn is positioned out of knitting engagement with the needle circle and is drawn by the previously knit portion thereof in a constricting loop around the welt-like fabric portion prior to completion thereof, thereby substantially reducing the tubular size of said welt-like fabric portion at said constricting loop, and auxiliary yarn clamping and cutting means mounted on the circular knitting machine adjacent the needle circle and spaced from said auxiliary yarn feeding member in the direction of needle circle rotation, said clamping and cutting means being operable to hold the leading end of said auxiliary yarn during movement of said auxiliary yarn feeding member to said feeding position for extension of said auxiliary yarn from said clamping and cutting means into engagement with said needle circle to initiate knitting, to release said auxiliary yarn following said initiation of knitting and to cut the trailing end of the auxiliary yarn during movement of the auxiliary yarn feeding member to its inoperative withdrawn position.

2. An auxiliary yarn feeding attachment according to claim 1 and characterized further in that said auxiliary yarn feeding member is disposed to engage said auxiliary yarn in said needle circle as said member is moved to said inoperative withdrawn position, with the needle circle carrying said auxiliary yarn for extension between the needle circle and said member into engagement by said clamping and cutting means for cutting of the auxiliary yarn extending from the needle circle and clamping of the auxiliary yarn extending from said member, the cut end of auxiliary yarn extending from the needle circle being positioned thereby for subsequent knitting in the welt-like fabric portion.

3. An auxiliary yarn feeding attachment according to claim 1, and characterized further by fabric take-down means movably mounted on said circular knitting machine below the needle circle and having a pair of clamping jaws opening upwardly for engaging and clamping the welt-like fabric portion following the completion of the knitting thereof, one of said jaws having an aperture therein and the other of said jaws having a projection thereon aligned with said aperture for extension therein upon closing of said jaws to clamp said fabric in said aperture, and means for moving said clamping jaws to apply a take-down pull on the clamped fabric.

* * * * *

UNITED STATES PATENT OFFICE

CERTIFICATE OF CORRECTION

Patent No. 4,037,435 Dated July 26, 1977

Inventor(s) Everardo Tapia

It is certified that error appears in the above-identified patent and that said Letters Patent are hereby corrected as shown below:

Column 8, line 32, delete "other" and insert therefor -- outer --. Column 9, line 31, delete "patter" and insert therefor -- pattern --. Column 10, line 30, delete "cuup-like frame 11" and insert therefor -- cup-like frame 111 --. Column 11, line 23, after "fabric" insert -- to --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*